United States Patent [19]

Carlson

[11] Patent Number: 4,950,082

[45] Date of Patent: Aug. 21, 1990

[54] MIXING APPARATUS

[76] Inventor: John T. Carlson, 811 Ashland Ave., St. Paul, Minn. 55104

[21] Appl. No.: 379,369

[22] Filed: Jul. 13, 1989

Related U.S. Application Data

[62] Division of Ser. No. 173,249, Mar. 24, 1988.

[51] Int. Cl.[5] ..... B01F 9/12

[52] U.S. Cl. ..... 366/130; 366/229; 366/605

[58] Field of Search ..... 366/130, 129, 210, 208, 366/209, 211, 228, 229, 216, 237, 238, 225, 57, 605, 343; 215/DIG. 8; 220/1 E, 83, 94 A, DIG. 12, DIG. 14, 228; 68/152, 153, 154, 171, 172, 173, 174; 206/219; 416/79

[56] References Cited

U.S. PATENT DOCUMENTS

| | | | |
|---|---|---|---|
| 54,776 | 5/1866 | Robinson | 366/130 |
| 1,134,354 | 4/1915 | Seifke | 366/130 X |
| 1,701,187 | 2/1929 | Maus | 366/238 X |
| 1,713,979 | 5/1929 | Redmond | 366/130 X |
| 2,156,541 | 5/1939 | Misenhimer et al. | 366/238 X |
| 2,208,431 | 7/1940 | Rochow | 366/130 |
| 2,592,485 | 4/1952 | Stair | 366/130 |
| 2,965,274 | 12/1960 | Brillis et al. | 366/130 X |
| 3,927,797 | 12/1975 | Flider | 220/94 A X |
| 4,253,772 | 3/1981 | Burton-Smith | 366/130 |
| 4,332,482 | 6/1982 | Engler | 366/605 X |

FOREIGN PATENT DOCUMENTS

| | | | |
|---|---|---|---|
| 827768 | 1/1952 | Fed. Rep. of Germany | 366/57 |
| 1168822 | 4/1964 | Fed. Rep. of Germany | 220/94 A |
| 544356 | 4/1942 | United Kingdom | 366/57 |

*Primary Examiner*—Harvey C. Hornsby
*Assistant Examiner*—Scott J. Haugland
*Attorney, Agent, or Firm*—Palmatier & Sjoquist

[57] ABSTRACT

A mixing apparatus for use in mixing liquids such as paints or oil base stains wherein the mixing apparatus consists of a plurality of inwardly extending perimeter baffles and upwardly extending inner baffles to obstruct the free flow of liquid during the rotation of the container and, in the preferred embodiment, the baffles are molded as an integral part of the liquid container to provide a convenient container wherein the liquid may be mixed by merely rotating the container.

4 Claims, 7 Drawing Sheets

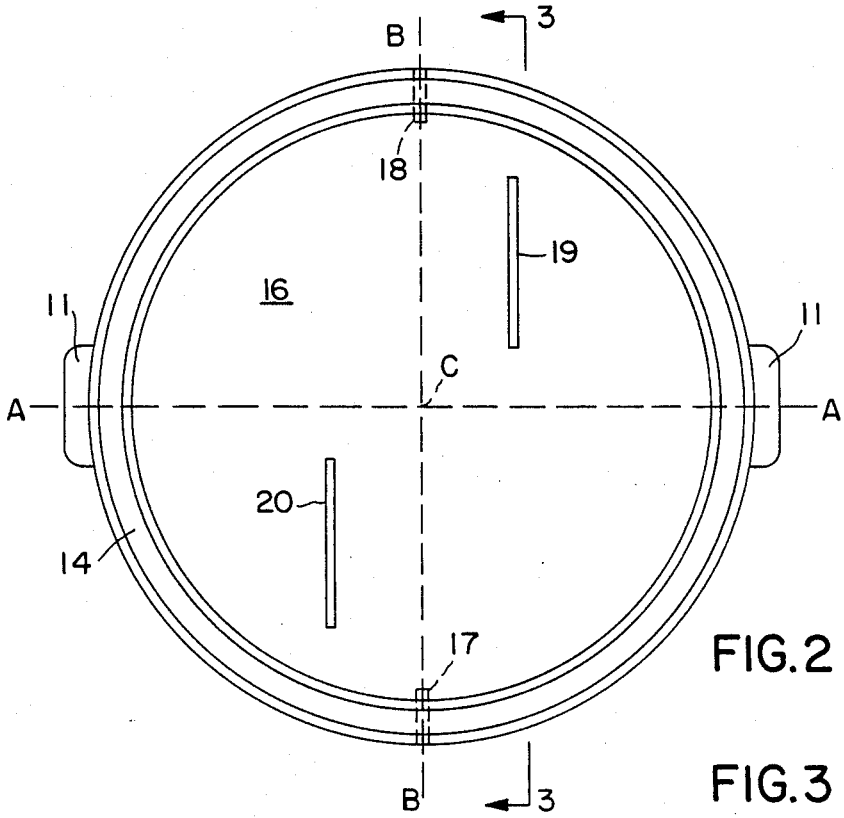
FIG. 2
FIG. 3
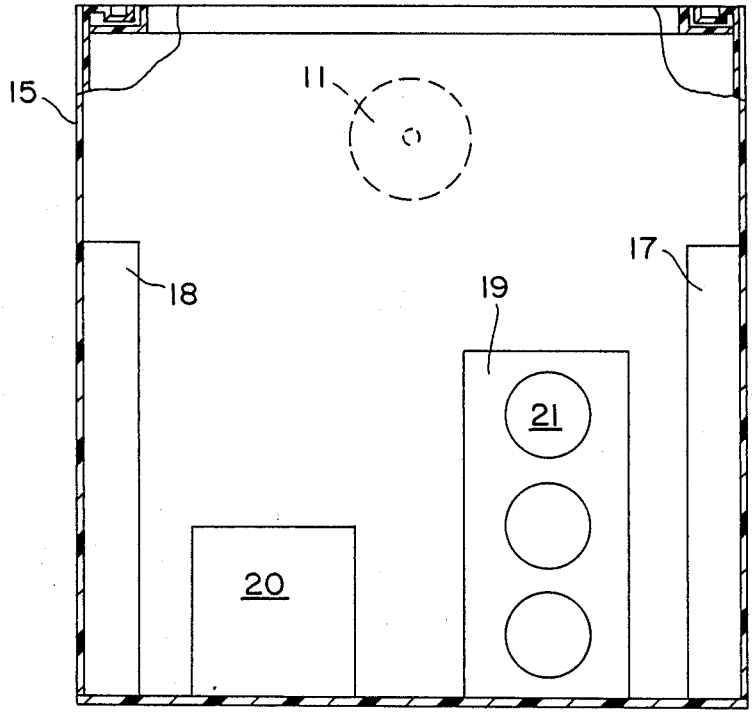

MIXING APPARATUS

This is a divisional of co-pending application Ser. No. 173,249 filed on Mar. 24, 1988.

BACKGROUND OF THE INVENTION

The present invention is directed to mixing devices for mixing viscous liquids such as paint or oil base stains and has a practical application whenever settling occurs in liquids or whereever the thorough mixing of samples is desired.

The problem with the separation of various paint components prior to their use is well known and is most commonly solved by stirring the paint with the all too familiar paint stick. Others have developed a variety of different inserts for use in paint mixing in an attempt to alleviate this problem. One example of a paint can insert is illustrated in U.S. Pat. No. 4,432,482 issued to Engler on June 1, 1982. The Engler patent discloses a round insert which has a plurality of mixing plates thereon arranged in a generally diagonal pattern to cause the fluid to move upwardly or downwardly depending upon the rotation of the container.

Another familiar approach is disclosed in U.S. Pat. No. 4,253,772, issued to Burton-Smith on Mar. 3, 1981. The Burton-Smith patent discloses a mixing pail having a pair of parallel, offset, oppositely directed baffles which are attached to the bottom of the pail and are designed to overlap at the center of the pail. Another insert of this type is the agitator disclosed by Hiser in U.S. Pat. No. 3,224,742. The Hiser invention consists of a plurality of radially extending arms which rotate along the bottom of the container to scrape the pigment from the bottom and sides of the container thereby mixing the pigment with the remaining paint.

The present invention provides the prior art's claimed advantages of simplicity and ease of manufacture. Additionally, with the increased use of plastic containers, one embodiment of the present invention may be molded as part of the plastic container to form a unitary mixing container capable of mixing the contents of the container whenever it is necessary. The use of a plastic container also aids in the cleaning and reusability of the container for the mixing of other liquids.

SUMMARY OF THE INVENTION

One object of the present invention is to create a mixing apparatus which is inexpensive and easy to manufacture.

Another object of the present invention is to provide a mixing apparatus having various baffles arranged to provide efficient mixing of the liquid.

Another object of the present invention to provide a mixing apparatus which is readily washable and may be reused numerous times.

The present invention may be produced as a separate insert or as an integral part of the container. In either embodiment, the invention consists of a pair of perimeter baffles which are positioned along the inner surface of the container. These perimeter baffles are preferably located perpendicular to the axis of the container handles and extend upwardly approximately two thirds of the height of the container. The perimeter baffles also extend inwardly from the container sides a short distance thereby creating an obstruction to the flow of liquid along the perimeter of the container.

Inwardly and offset from the perimeter baffles are a pair of inner baffles. The inner baffles are generally parallel to the perimeter baffles and perpendicular to the container handles. The inner baffles are preferably offset from the center point of the container and are positioned approximately one inch on each side of the axis of a line drawn between the perimeter baffles. One of the inner baffles extends upwardly from the bottom of the container approximately one half of the height of the container. The other inner baffle preferably extends upwardly from the bottom of the container approximately one fourth of the height of the container. The length of both inner baffles is approximately one fourth of the diameter of the container and the inner baffles are positioned so that none of the baffles overlap.

The taller inner baffle may also contain openings therein to further facilitate the mixing of the liquid in the container by creating yet another route for the liquid to flow. Due to the relatively small height of the second inner baffle, the use of openings therein does not materially aid in the mixing of the liquid and therefore based primarily on the concern for the ease of manufacture of the invention these openings are preferably omitted.

One advantage of the present invention is that is may be manufactured as a separate insert for use in containers of various sizes.

Another advantage of the present invention is that it may be molded as part of the container and adapted for use in nearly any size plastic container.

Another advantage of the present invention is that it is simple and inexpensive to manufacture.

BRIEF DESCRIPTION OF THE DRAWINGS

FIG. 2 is a top view of the present invention;

FIG. 3 is a side view of the present invention taken along lines 3—3 of FIG. 2.

FIG. 8 is a cross sectional view taken along lines 8—8 of FIG. 6.

DETAILED DESCRIPTION OF THE PREFERRED EMBODIMENT

In the foregoing description of my invention, I describe the preferred dimensions of the invention solely to assist in understanding the preferred embodiment and is not intended to limit the scope of my invention. The preferred dimensions are made with reference to the most commonly available container which is referred to herein as a standard container and measures 7¼ inches high and has a diameter of 6½ inches. In addition to the preferred dimensions, I have included the preferred ratio of the individual component with the overall height and diameter of the container to facilitate the adaptation of the present invention to non-standard containers. Finally, the preferred embodiment is molded using injection molding; however, as disclosed below, the present invention may be modified for use in other molding methods such as blow molding or rotational molding.

Figure 1:
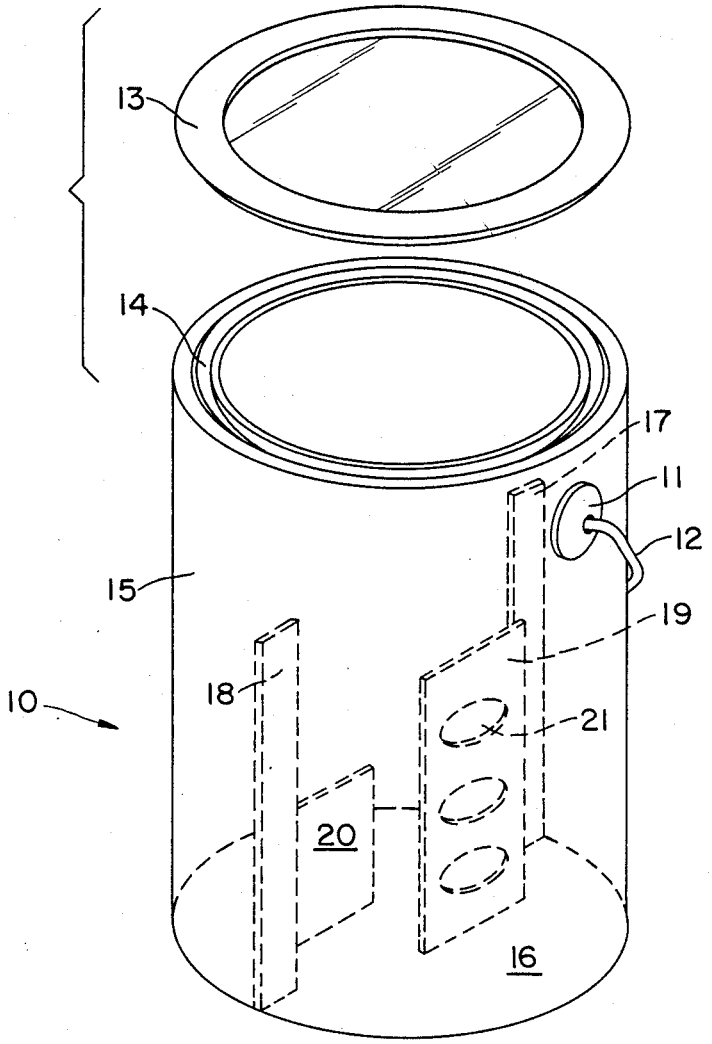
FIG. 1 is a perspective diagrammatical view of the present invention.

Referring to FIG. 1, there is shown one embodiment of my invention, wherein the invention is molded as an integral part of a plastic cylindrical container 10. The outer surface of the container 10 includes a pair of handle attachments 11 into which a handle 12 for the container 10 is inserted. Additionally, the container 10 includes a cover 13, a container lip 14, sides 15 and bottom 16.

The mixing apparatus of the present invention includes a pair of perimeter baffles, 17 and 18, respectively, and a pair of inner baffles, 19 and 20, respectively. FIG. 2 illustrates the preferred location and dimension of the baffles which are discussed more fully herein. Reference is made to line A which is a reference line drawn between the handle attachments 11 and to line B which is a reference line drawn between the perimeter baffles, 17 and 18. In the preferred embodiment, the perimeter baffles 17 and 18, are arranged perpendicular to line A and extend inwardly from the inner surface of the container side 15. The perimeter baffles, 17 and 18, preferably extend inwardly from the side 15 of the container 10 approximately one half inch or about one twelfth of the diameter of the container. The perimeter baffles, 17 and 18, extend upwardly from the bottom 16 of the container 10 approximately 4¾ inches or about two-thirds the height of the container. The top third of the container side 15 does not include the perimeter baffles 17 and 18 thereby decreasing the potential for liquid from dripping from the perimeter baffles 17 and 18 when liquid is poured from the container 10. Additionally, the top third of the container side 15 may be tapered inwardly (not shown) to provide a container 10 which facilitates the pouring of the liquid therefrom.

As illustrated in FIG. 2, the inner baffles 19 and 20, respectively, are located parallel to the perimeter baffles 17 and 18 and are offset from line B approximately ⅞ of an inch. Additionally, the outermost end of the inner baffles 19 and 20, respectively, is located at an angle approximately 22 degrees from line B and central point C of the container 10. Each inner baffle 19 and 20, respectively, is approximately 1⅝ inches long or one-fourth the diameter of the container 10.

FIG. 3 illustrates the preferred height of the respective baffles. As described above, perimeter baffles 17 and 18 extend upwardly approximately two-thirds the height of container 10. Inner baffle 19 extends upwardly from the bottom 16 of the container 10 approximately 3¾ inches or, alternatively, one half of the height of the container 10. Inner baffle 19 also contains a plurality of openings 21 which are spaced equidistant along the inner baffle 19 and have a preferred diameter of ¾ of an inch. Inner baffle 20 is preferably 1¾ inches high or approximately one-fourth the height of the container, and due to its relatively small height, it does not contain the openings 21 as described for inner baffle 19.

Figure 4:
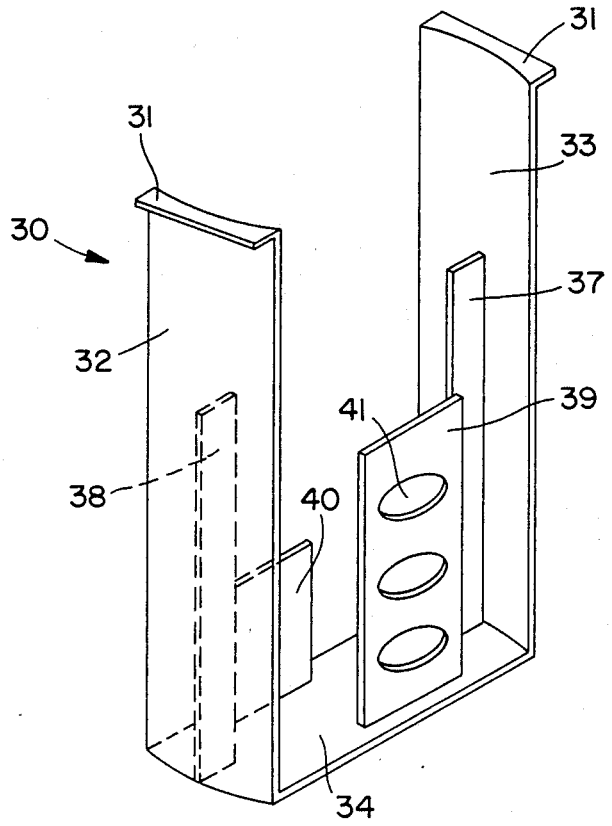
FIG. 4 is a perspective view of an alternate embodiment of the present invention.
Figure 5:
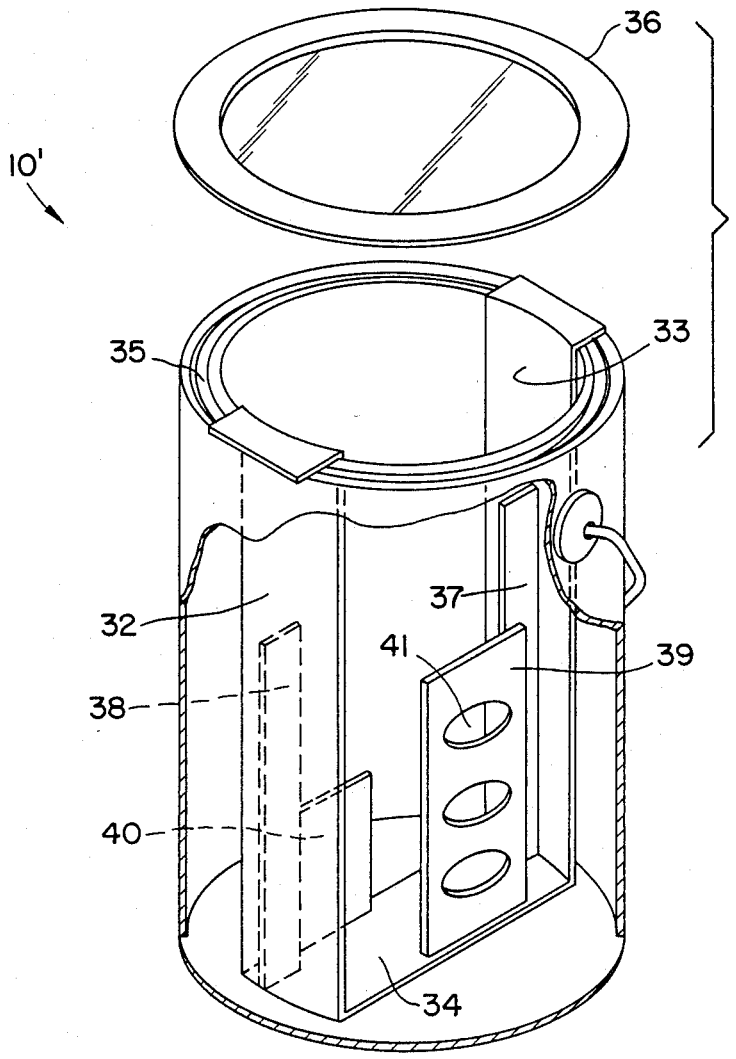
FIG. 5 is a perspective view with a partial cutaway to illustrate the embodiment of the present FIG. 4 in a standard container.
Figure 6:
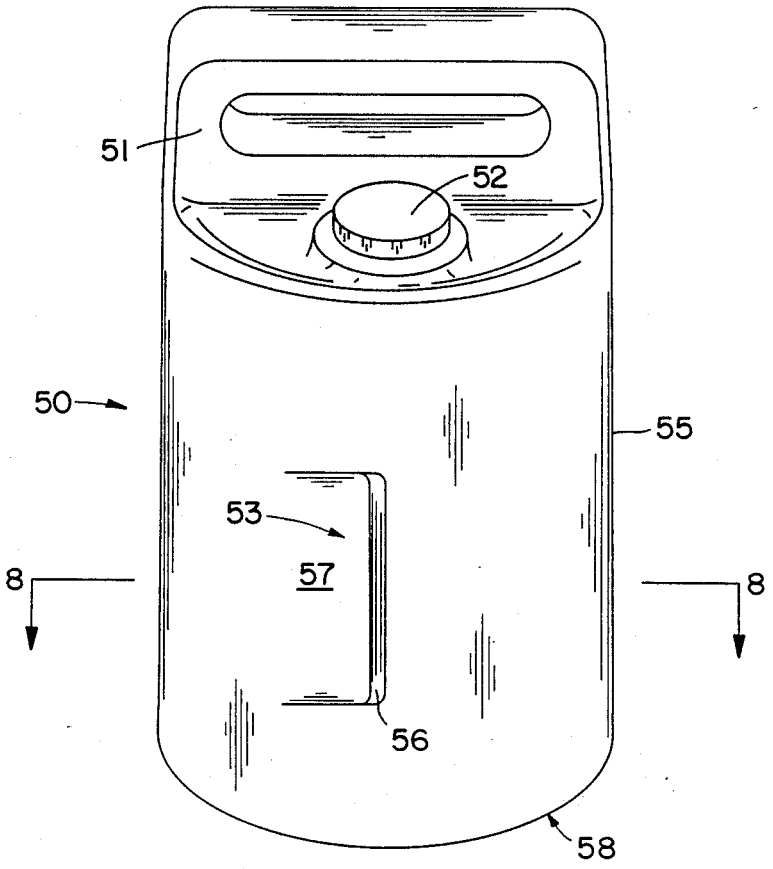
FIG. 6 is a perspective view of an alternate embodiment of the present invention.
Figure 7:
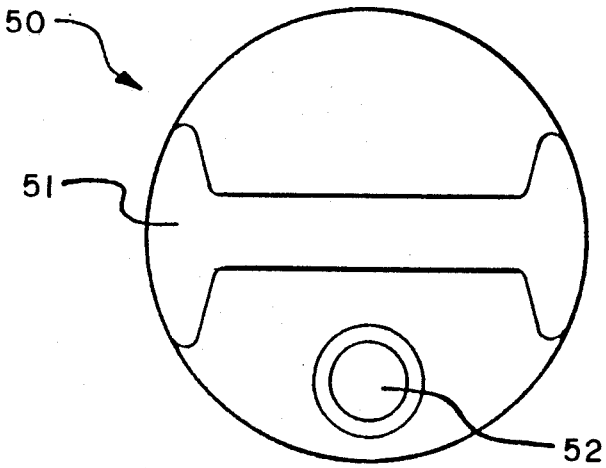
FIG. 7 is a top view of the embodiment illustrated in FIG. 6.
Figure 9:
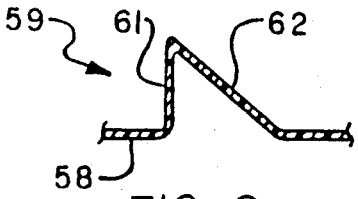
FIG. 9 is a cross sectional view taken along line 9—9 of FIG. 8.

The second embodiment is illustrated in FIGS. 4 and 5 and consists of a container insert referred to herein as 30. This insert 30 consists of at least one insert attachment 31, insert sides 32 and 33, and insert base 34. The insert attachment 31 extends upwardly from the insert sides 32 or 33 and is contoured to fit within the lip 35 of the container 10'. When the lid 36 of the container 10' is snapped into place the insert 30 is held in position. The insert sides 32 and 33 are attached at their lower ends to insert base 34. The insert base 34 is preferably 2 inches wide and the insert sides 32 and 33 and insert attachment 31 need only be of a sufficient width to adequately support the perimeter baffles 37 and 38 and hold the insert 30 in position while the container 10' is rotated.

The perimeter baffles 37 and 38 are preferably centered along the insert sides 32 and 33 and extend upwardly from the insert base 34. As with the first embodiment, the perimeter baffles 37 and 38 preferably extend upwardly along the insert sides 32 and 33, approximately 4¾ inches or about two thirds of the height of the container. The perimeter baffles 37 and 38 extend inwardly from the insert sides 32 and 33 approximately one-half inch or about one-twelfth of the diameter of the container 10'.

The inner baffles 39 and 40, respectively, are attached to the insert base 34 and are positioned parallel to the perimeter baffles 37 and 38. As with the first embodiment, the inner baffles 39 and 40, respectively, are offset from a reference line drawn between the perimeter baffles 37 and 38 approximately ⅞ of an inch. The inner baffles 39 and 40 are approximately 1⅝ inches long or one fourth of the diameter of the container 10' and the outermost ends of the inner baffles 39 and 40 are located at a 22 degree angle from the reference lines and center point of the container.

Inner baffle 39 extends upwardly from the insert base 34 approximately 3¾ inches or one-half of the height of the container 10'. Inner baffle 39 also includes a plurality of openings 41 which are spaced equidistant along the inner baffle 39 to create a further route of flow for the liquid. Inner baffle 40 is preferably 1¾ inches high or one-fourth of the height of the containers.

FIGS. 6–9 illustrate the preferred form of my present invention when rotational molding or blow molding is used. The container 50 in this form of the invention includes an elevated molded handle 51 and a top opening 52 to facilitate the convenient handling and pouring of paint or oil base stains from the container 50. It is anticipated that this type of container 50 will be manufactured as a one gallon container; however, the preferred size of the container 50 is dependent on the final convenient carrying weight of the container 50.

In this form of the invention, the perimeter baffles 53 and 54 extend inwardly from the container side 55 approximately three-fourths of an inch or about one-eighth of the diameter of the container 50. The perimeter baffles 53 and 54 have a front side 56 which projects abruptly into the interior of the container 50 and a back side 57 which gradually decreases in width until it reaches the side 55 of the container 50. The perimeter baffles 53 and 54 begin approximately 1¼ inch from the container bottom 58 and are nearly three inches long or one-half of the height of the cylindrical portion of the container 50.

The inner baffles 59 and 60 are offset from the perimeter baffles 53 and 54 and approximately one half inch from the center of the container bottom 58. Each inner baffle 59 or 60 includes a front side 61 which abruptly extends upwardly from the container bottom 58 approximately one inch or nearly one-sixth of the height of the container 50. The front side 61 of each inner baffle 59 or 60 is approximately two inches long and extends outwardly to about one inch from container side 55. The back side 62 of each inner baffle 59 and 60 gradually decrease in height until it reaches the container bottom 58. The inner and outer edges of each inner baffle 59 and 60 project inwardly from the container bottom 58 for about 45° of a 360° circle drawn at the inner or outer edge 62 or 63 of the respective inner baffle 59 or 60.

In this embodiment the front side 56 of perimeter baffle 53 and the front side 61 of inner baffle 59 are oriented to face the same direction of rotation of the container 50. The front side 56 of perimeter baffle 54 and the front side 61 of inner baffle 60 are oriented opposite the orientation of perimeter baffle 53 or inner baffle 59. By arranging the baffles in this manner, if the container 50 is rotated to the right, the paint or stain will contact the front side 61 of inner baffle 59, the front side 56 of perimeter baffle 53, the back side 62 of inner baffle 60 and the back side 57 of perimeter baffle 54. When the container 50 is rotated to the left, the front side 61 of inner baffle 60, the front side 56 of perimeter baffle 54, the back side 62 of inner baffle 53 and the back side 57 of perimeter baffle 53 will be encountered.

What is claimed:

1. A mixing apparatus for mixing liquids, comprising a container for liquids having a top surface, side surfaces and a bottom surface, said top surface having a handle thereon for carrying the container, said side surfaces having at least two spaced inwardly projecting perimeter baffles thereon, said perimeter baffles each are comprised of a front side and a back side wherein said perimeter baffle front side abruptly projects inwardly from said side surface and said perimeter baffle back side gradually tapers from said perimeter baffle front side to said side surface;

said bottom surface having at least two spaced upwardly extending inner baffles thereon, and said inner baffles each having an inner baffle front side and an inner baffle back side, wherein said inner baffle front side abruptly projects upwardly from said bottom surface and said inner baffle back side gradually tapers from said inner baffle front side to said bottom surface.

2. The mixing apparatus of claim 1, wherein said front sides of said inner baffles are oriented so that when said container is rotated, the free flow of liquid along bottom surface is obstructed and mixed by the front side of one inner baffle and then contacted by the tapered back side of the other inner baffle.

3. The mixing apparatus of claim 1, wherein aid perimeter baffles are oriented so that during one direction of rotation, the front sides of one inner baffle and one perimeter baffle will encounter and mix the liquid while the tapered back sides of the other inner baffle and the other perimeter baffle will be encountered.

4. The mixing apparatus of claim 1, wherein the inner baffles and perimeter baffles are oriented so that when said container is rotated, the free flow of liquid is obstructed and mixed by the front side of one inner baffle, then by the front side of one inner baffle, then encountered by the tapered back side of the other perimeter baffle, and then by the tapered back side of the other perimeter baffle.

* * * * *

UNITED STATES PATENT AND TRADEMARK OFFICE

CERTIFICATE OF CORRECTION

PATENT NO. : 4,950,082

DATED : August 21, 1990

INVENTOR(S) : John T. Carlson

It is certified that error appears in the above-identified patent and that said Letters Patent is hereby corrected as shown below:

The sheet of drawings consisting of Fig. 8, should be added as shown on the attached page.

Signed and Sealed this

Eleventh Day of February, 1992

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,950,082

DATED : August 21, 1990

INVENTOR(S) : John T. Carlson

It is certified that error appears in the above-identified patent and that said Letters Patent is hereby corrected as shown below:

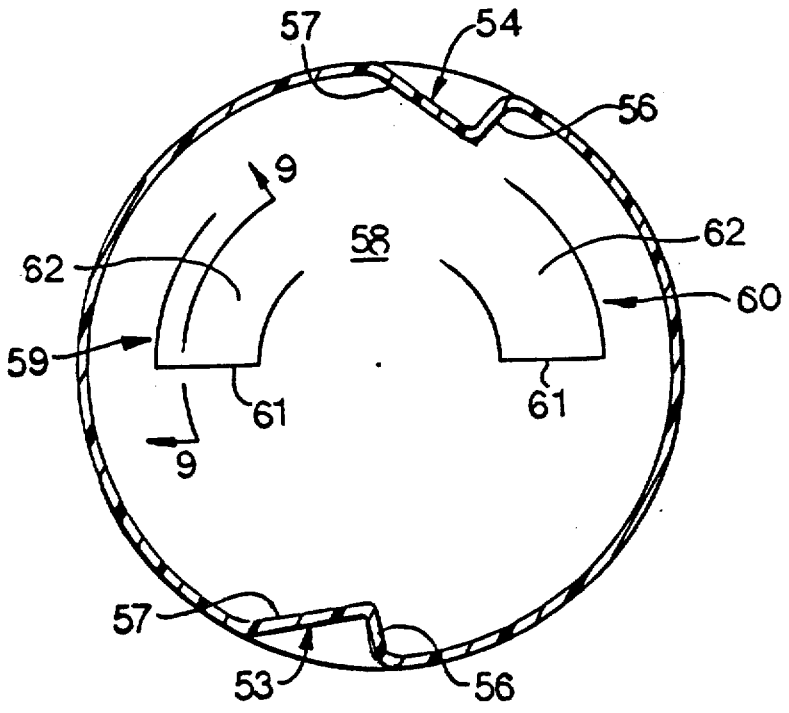

FIG. 8